United States Patent [19]

Burnett

[11] 4,035,955

[45] July 19, 1977

[54] BOOM GATE

[76] Inventor: David Burnett, 29 Albion St., Surry Hills, Sydney, New South Wales 2010, Australia

[21] Appl. No.: 558,712

[22] Filed: Mar. 14, 1975

[30] Foreign Application Priority Data

Jan. 23, 1975 Australia ..... 0350/75

[51] Int. Cl.[2] ..... E05F 1/00

[52] U.S. Cl. ..... 49/280; 49/387

[58] Field of Search ..... 49/236, 240, 245, 272, 49/280, 286, 291, 344, 379, 385, 386, 387; 214/146.5, 148; 248/123, 325, 364; 272/54, 55, 56; 74/36

[56] References Cited

U.S. PATENT DOCUMENTS

| | | | |
|---|---|---|---|
| 356,325 | 1/1887 | Mills | 49/387 X |
| 364,470 | 6/1887 | Blake | 248/123 |
| 690,006 | 12/1901 | Anthony | 49/387 X |
| 898,487 | 9/1908 | Janier | 248/123 X |
| 1,416,162 | 5/1922 | Black | 49/385 |
| 1,600,745 | 9/1926 | Tickner | 49/379 X |
| 3,749,342 | 7/1973 | Perrine | 248/123 |
| 3,877,174 | 4/1975 | McDonald | 49/379 X |

FOREIGN PATENT DOCUMENTS

| | | | |
|---|---|---|---|
| 636,674 | 10/1936 | Germany | 49/236 |
| 289,158 | 4/1928 | United Kingdom | 49/240 |

*Primary Examiner*—William H. Schultz

[57] ABSTRACT

A boom gate comprises a first-class lever counterweighted at one end adjacent to which is the lever fulcrum. The fulcrum is displaceable lengthwise of the lever through a short distance sufficient to cross the center of gravity of the lever. This movement is controlled by a mechanism and the boom lifts automatically under its own weight when the center of gravity is passed. The advantage of such a system is that the effort required to raise the boom is very little and the use of high-torque equipment is unnecessary so that the boom gate can be cheaply made. Ways of displacing the fulcrum using pneumatic pressure, a handle or an electric motor are described. Also a double-sided boom gate is described.

9 Claims, 11 Drawing Figures

BOOM GATE

FIELD OF THE INVENTION

This invention relates to a boom gate which is commonly used to control access to a thoroughfare. Such boom gates are encountered at level crossings, car park entrances, customs barriers, and ticket offices, to name just a few of its numerous uses. It is usually used in order to control vehicular traffic.

STATE OF THE ART

Conventional boom gates comprise a pillar which is disposed on one side of a thoroughfare to be controlled, and which has a boom in the form of a cantilever supported on the pillar. The boom is generally of light construction and is attached at one end to a shaft which is rotatable, through gearing, by an electric motor. Control equipment is often built into the pillar also. To reduce the load on the motor the boom is often counterweighted. A relatively large motor is necessary because the torque required to raise a long boom quickly from a horizontal position to a near vertical position by means of a shaft at one end of the boom, is considerable.

OBJECT OF THE INVENTION

One object of the invention is to provide a simply constructed boom gate which is easier to operate than boom gates of the prior art and which is also cheaper to make and more versatile in its operation.

THE INVENTION

A boom gate, in accordance with the present invention, comprises a first-class lever having a counterweight at one end adjacent which is a fulcrum which is moveable lengthwise of the lever through a range of positions which cross the centre of gravity of the lever. When the fulcrum is at the end of its movement adjacent the counter-weighted end of the lever, the other end of the lever which forms the actual boom exerts a greater turning moment about the fulcrum, causing the boom gate to descent automatically under its own weight without any external power having to be applied. When the fulcrum is moved to the other end of its range of movement it crosses the centre of gravity of the lever so that the counter-weighted end exerts the greater moment and the boom lifts automatically to an upright or near upright position.

PREFERRED FEATURES

Preferably the movement of the fulcrum takes place by physically moving the lever with respect to a supporting pillar. This has the advantage that such movement can be used to release the free end of the boom, when in the horizontal position, from a retaining latch. This latch prevents vertical movement of the boom unless it is first displaced towards the supporting pillar.

Various systems may be used for displacing the fulcrum. An electric motor drive, a pneumatic unit or a manual system may be used. Preferably, whatever system is used, it is arranged to lift the boom by displacing the portion of the lever adjacent the fulcrum diagonally upwards so as to provide a horizontal component to retract the free end of the boom from a latch and to increase the turning movement of the lever in the gate-opening direction, and also a vertical component which ensures that the boom lifts to a vertical position with respect to the pillar.

The invention will now be described in more detail, by way of examples, with reference to the accompanying drawings in which:

IN THE DRAWINGS

Figure 1:
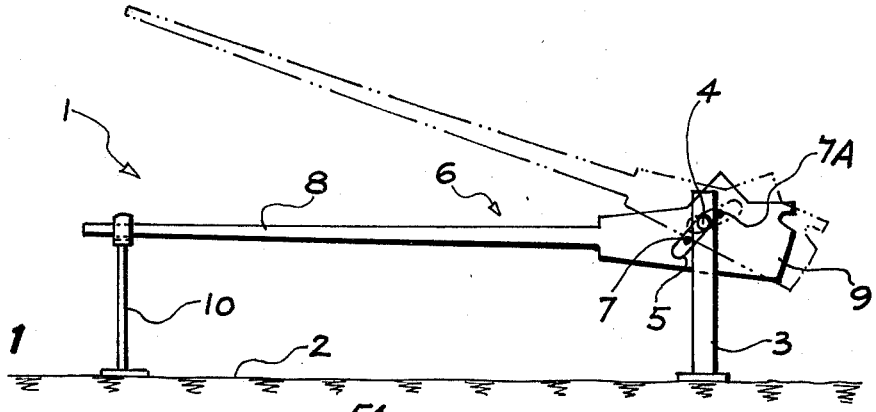
FIG. 1 is a diagrammatic side view of a boom gate shown closed in full outline and in a half opened condition in broken outline.
Figure 2:
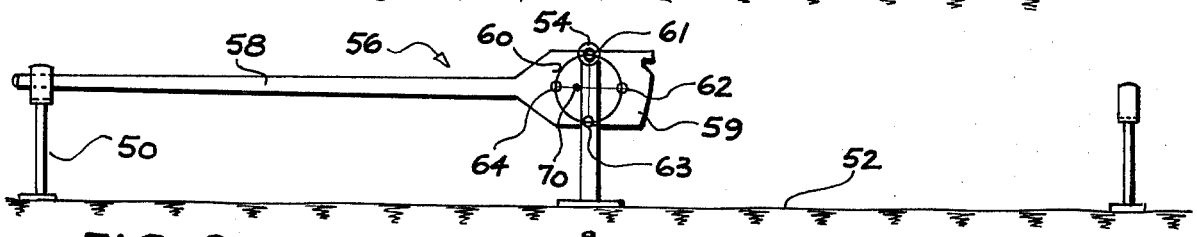
FIG. 2 shows a view similar to FIG. 1 but of a modified form of boom gate.
Figure 4:
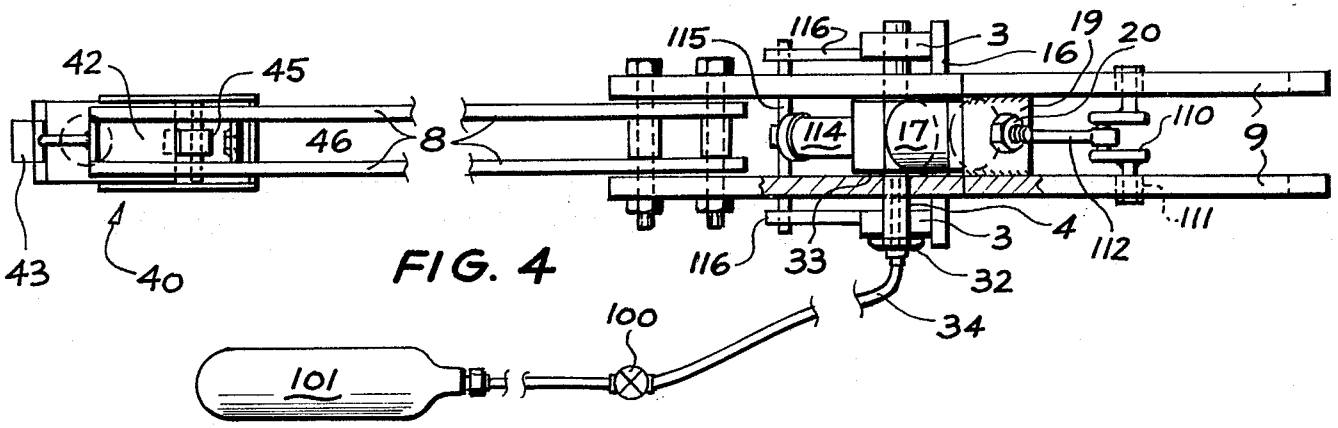
Figure 3:
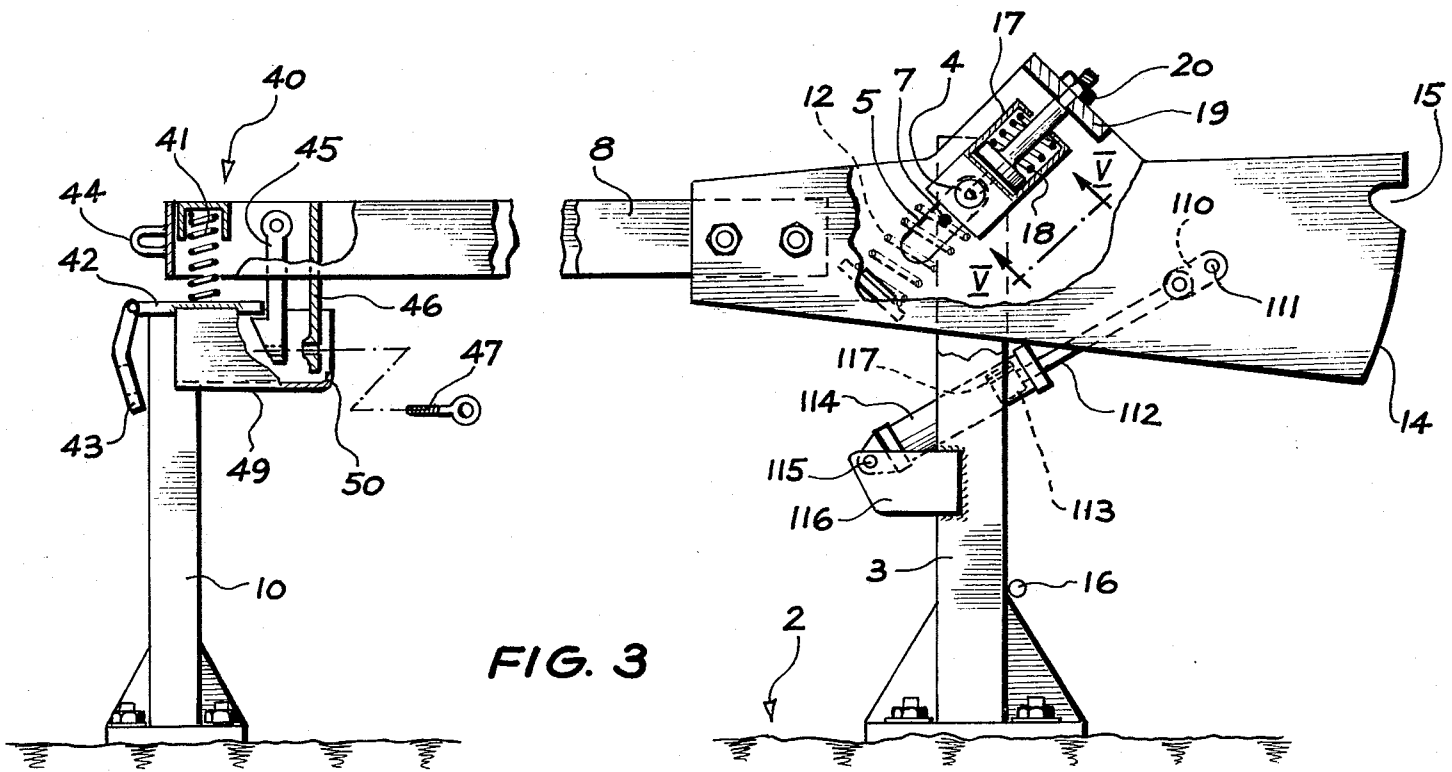
Figure 5:
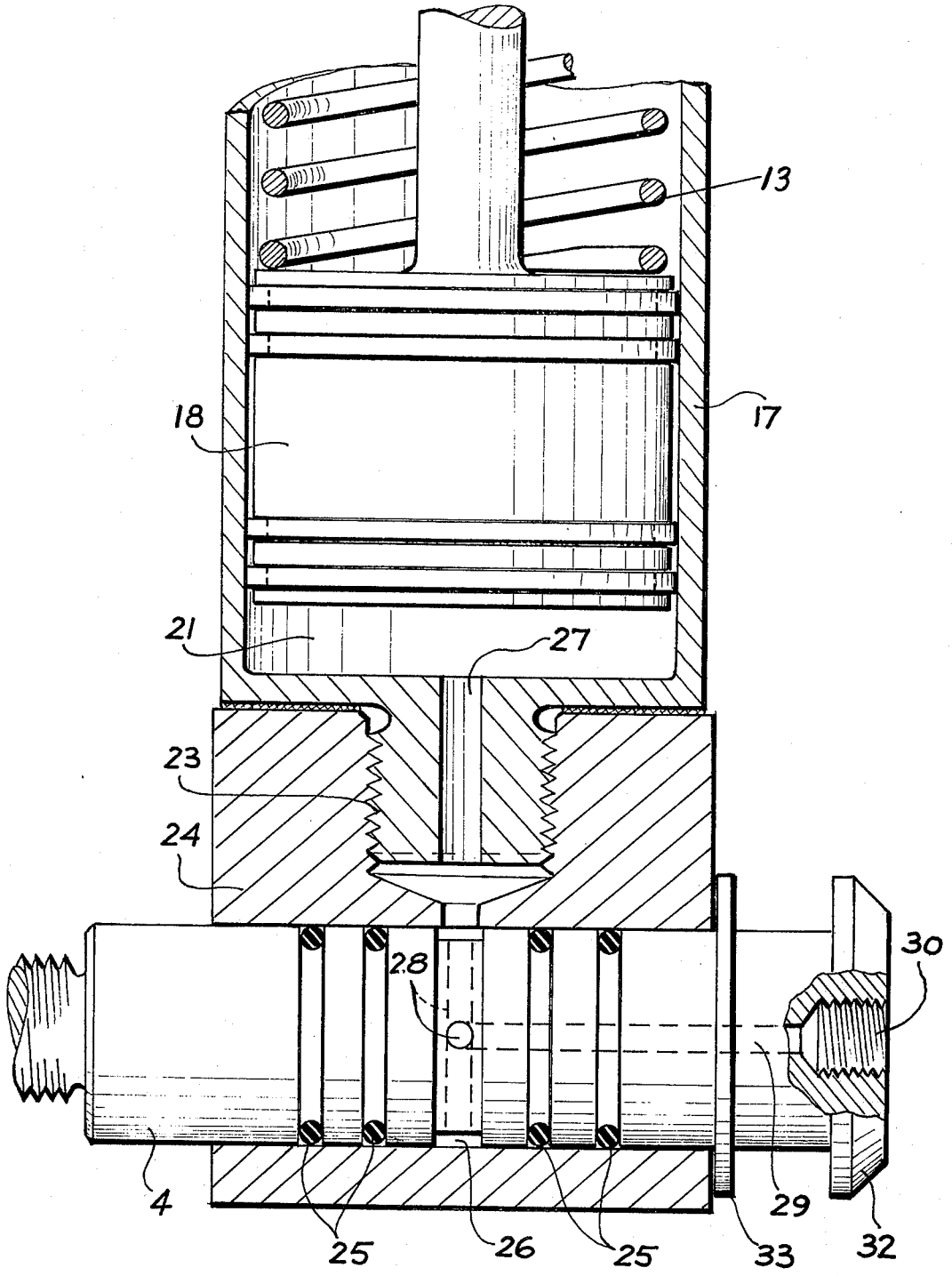
Figure 7:
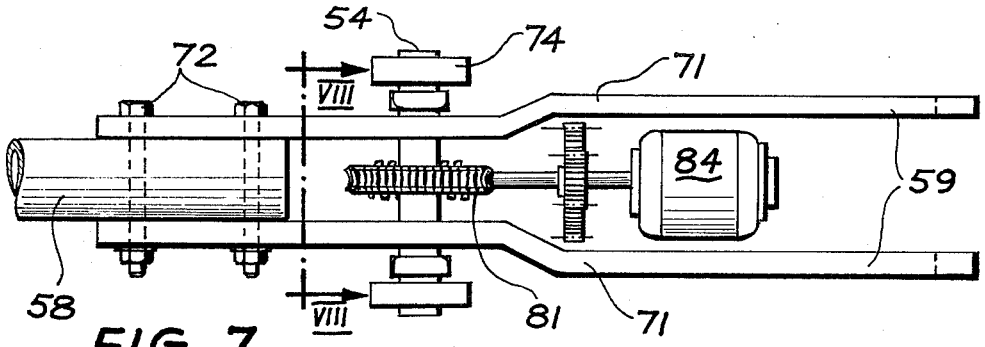
Figure 6:
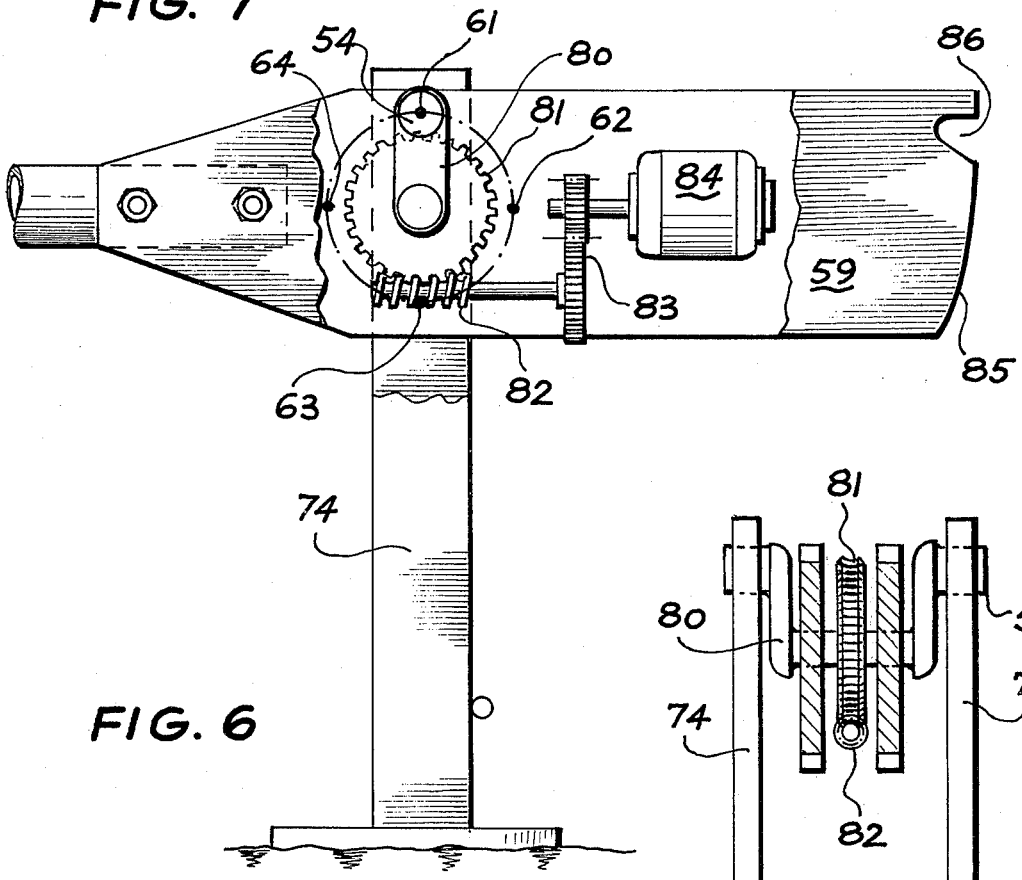
Figure 8:
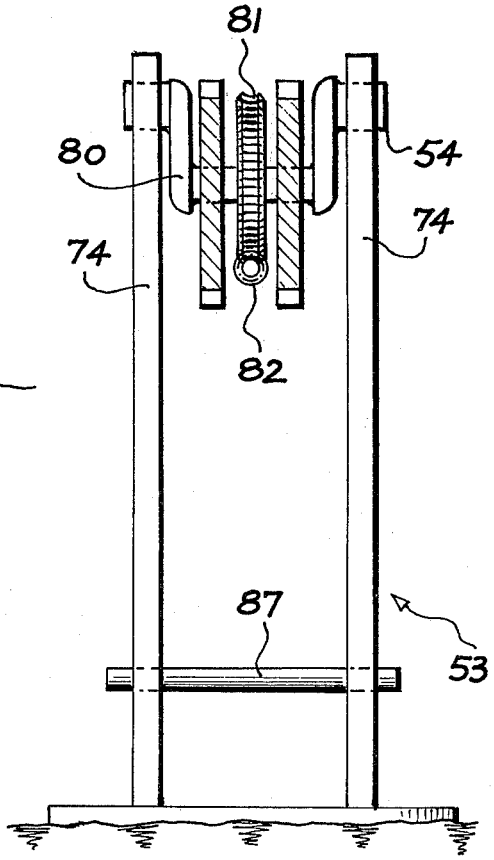
Figures 9, 10:
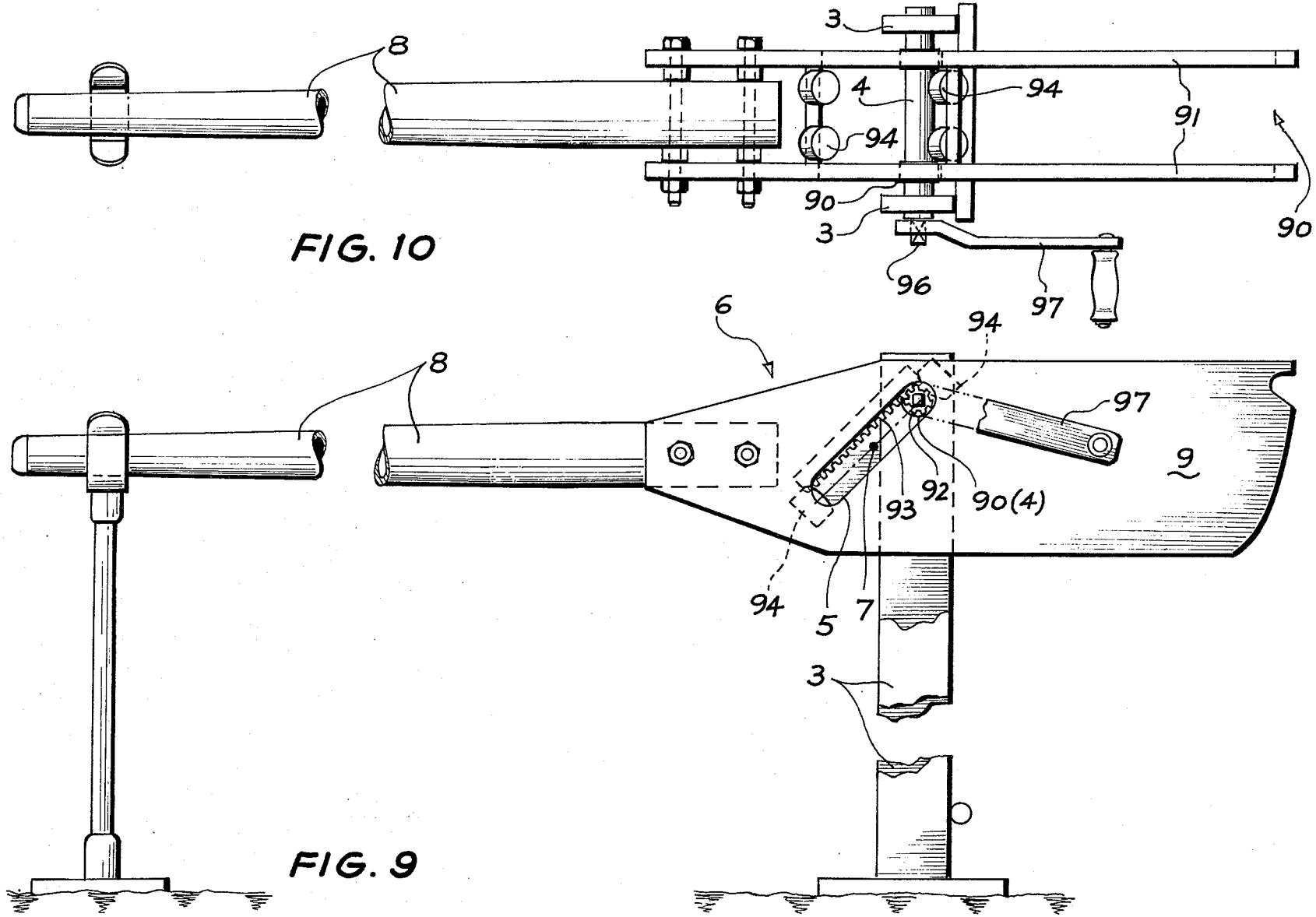

FIGS. *2a*, *2b* and *2c* show the boom gate of FIG. 2 in various positions and used to selectively close two parallel thoroughfares;

FIG. 3 shows a boom gate in side elevation and operating in accordance with FIG. 1, portions of the boom gate being broken away to expose internal detail;

FIG. 4 is a plan view of FIG. 3;

FIG. 5 shows a detail of FIG. 3, as denoted by the arrows V—V in that Figure, in cross section;

FIG. 6 shows a boom gate which operates in accordance with FIGS. 2 to *2c*, parts of the boom gate being broken away to expose internal detail and other parts, unnecessary for an understanding of the invention, being omitted for the sake of clarity;

FIG. 7 is a top plan view of FIG. 6;

FIG. 8 is a cross section through 7 taken along the line and in the direction indicated by the arrows VIII—VIII in that Figure;

FIG. 9 shows working parts of a third embodiment of boom gate and which operates in accordance with the principles explained with reference to FIG. 1 but is manually controlled; and FIG. 10 is a plan view of FIG. 9.

FIRST EMBODIMENT

FIG. 1 shows a boom gate 1 controlling vehicular access along a thoroughfare 2. The boom gate comprises a pillar 3 having a horizontal pivot pin 4 which passes through a diagonal slot 5 in a first-class lever 6. The centre of gravity of the lever is shown at 7 approximately midway along slot 5. One side of the lever is formed by a boom 8 and the other side by a counterweight 9. In its lowest position the extremity of the boom 8 rests on a pedestal 10.

To operate the boom gate the lever 6 is lifted in the direction of the slot 5 by means, not illustrated, which will be described later. This produces two effects which are the withdrawal horizontally of the terminal portion of the boom 8 from pedestal 10, and the displacement of the centre of gravity 7 of the lever 6 to a position 7A on the right of the pivot pin 4. In consequence, the turning moment of the counter-weight 9 about the fulcrum provided by the pivot pin 4 is greater than that of the contrary turning moment produced by the boom 8, and the boom gate opens. Opening movement continues until the boom 8 is vertical because the effect of shifting the centre of gravity 7A of the lever 6 to the right of the pivot pin 4, is to provide a turning moment which continues until the centre of gravity 7A lies beneath the pivot pin 4. This actually would occur when the boom had swung past the vertical but a stop, not shown, prevents such movement so that the boom remains in the vertical position as long as the gate is open.

To close the gate, the aforementioned means are reversely operated to displace the slot 5 to the left in FIG. 1, in relation to the pivot pin 4, so that the centre of gravity of the lever 6 now lies to the left of the pivot pin 4 and the turning movement of the boom 8, being greater, causes the boom gate to close.

FIGS. 3, 4 and 5 show the boom gate in more detail. The pillar 3 is bifurcated and the pivot pin 4 extend between the bifurcations and carries between them the lever 6. The slot 5 comprises two parallel slots each formed in a respective plate which together provide the counter-weighted end 9 of the lever. The end edge of the counter-weighted end 9 is arched as shown at 14 and is provided with a socket 15 which receives a stud 16 provided towards the foot of the pillar 3 when the boom 8 is vertical.

The means for controlling the position of the slot 5 with respect to the pivot pin 4 comprises a piston and cylinder unit 17. This cylinder of the unit has an apertured lug at one end through which passes the pivot pin 4. The piston of the unit, shown at 18, is provided with a piston rod whose terminal end is threaded and passes through an apertured gusset plate 19. It is held in place by a nut 20.

The piston 18 divides the cylinder 17 into two chambers one of which exhausts to atmosphere and the other to which is referenced 21 in FIG. 5. A coil compression spring 13 is located within the chamber of the cylinder which exhausts to atmosphere. From FIG. 5 it will be seen that the cylinder 17 has a stem screwed into a threaded bore 23 in a block 24 which provides the aforesaid lug and is pivoted to the pin 4. Sealing O-rings 25 are located in pairs on opposite sides of a peripheral neck 26 extending around the pivot pin 4. Registering bores 27 formed in the threaded stem of the cylinder 17 and the block 24 provide a through passage leading into the working chamber 21 from crossed diametric passages 28 provided in the pivot pin 4. These passages 28 intersect one another at the end of an axial passage 29 extending through the pivot pin 4 from a nozzle socket 30 lying in the outside surface of an end plate 32. One of the bifurcations 3 and one lever plate lies between the end plate 32 and a second plate 33 which is attached to the block 24 to prevent it from moving lengthwise of the pivot pin 4.

As shown in FIG. 4 a gas pipe 34 extends to valving 100 which controls the admission to the cylinder 17 of pneumatic working fluid stored in a gas bottle 101.

The boom 8 is provided by a pair of light aluminium strips bolted to the metal plates of the end-portion 9 so that, in the event of the strips being broken, they can quickly be replaced. At their ends, the strips carry latching housing 40 shown in FIGS. 3 and 4.

The latching housing contains a spring loaded shock absorber 41 which rests on the top of a latch plate 42 provided on top of the pedestal 10. A pivoted yoke 43 is also attached to the latch plate 42 and can be swung up so that it passes over an eye 44 provided in the end of the housing to enable a padlock to be used to prevent the boom gate being raised when left unattended.

The housing 40 also carries a pendant latching pawl 45 which, when the boom is lowered, engages beneath the marginal portion of the latching plate 42 as shown. A locking plate 46 is also provided in the housing and extends parallel but spaced from the latching pawl 45. It is provided with a threaded aperture to enable an eye bolt 47 to be screwed into it so that the end of the eye bolt locks the pawl 45 in its engaged position beneath the latching plate 42. The latch plate 42 forms the top wall of a latching box 49 in which the locking plate 46 and the latch pawl 45 locate when the boom gate is closed. When the eye bolt 47 is screwed into the plate 46 to engage the latching pawl 45, the latching pawl 45 cannot be swung out of engagement with the latching plate 42 except by moving the slot 5 of the lever 6 across the pivot pin 4. A latching mechanism is thus provided in part by a housing 40 and in part by the box 49.

OPERATION OF FIRST EMBODIMENT

When the boom gate is not in use its parts lie in the positions shown in FIGS. 3 and 4. To operate the boom gate, valve 100 is opened to allow compressed gas from the gas bottle 101 to enter the gas pipe 34, the passage 29 in the pivot 4, and to flow via the diametric passages 28 and the registering bores 27 into the working chamber 21 of the piston cylinder unit. This forces the piston upwards and to the right (see FIG. 3) so that the slot 5 of the lever 6 participates in this movement to shift the center of gravity 7 of the lever 6 to the right of the pivot pin 4. Simultaneously, the left hand end of the boom slides towards the pillar 3 to disengage the latching pawl 45 from the latch plate 42. When the two free from one another, the boom gate opens under its own weight and rotates about the pivot pin 4 which at this time is located at the lower end of the slot 5. As the boom 8 approaches the vertical position, the arched surface 14 runs over the surface of the stud 16 until the socket 15 can engage with the stud.

The gate remains open as long as pneumatic pressure is applied to the cylinder 17. To close the gate, the gas bottle valve is closed and normal leakage of pneumatic fluid allows the spring 13 to restore the piston 18 to the position, shown in FIG. 3 in the cylinder 17. This has the effect of lifting the lever 6 once again so that the center of gravity 7 locates on the left hand side of the pivot 4 (see FIG. 1) and a turning moment is produced causing the boom gate to close. Towards terminal closing movement of the boom gate the latching pawl 45 slips past the end of the latching place 42 and the shock absorber 41 prevents excessive shock to the boom gate when it closes.

During times when the boom gate is left temporarily unattended, the operator can hold it closed by inserting the eye bolt 47 in the locking plate 46. If the boom gate is to be left unattended for an extended length of time, the yoke 43 can be padlocked to the eye 44.

MODIFICATIONS OF FIRST EMBODIMENT

Shown in broken outline in FIGS. 3 and 4 is a damper unit which can be used to control the rate of descent of the boom gate. The unit comprises a crankshaft 110 journalled at 111 to respective plates of the end-portion 9. Pivoted to the central cranked portion of the shaft 110 is one end of a piston rod 112 whose other end carries a piston 113 movable in a cylinder 114 which is pivoted at 115 to lugs 116 provided on respective bifurcations 3 of the pillar. The piston 113 has a bleed opening 117 extending between its opposite faces (and which controls the rate of its movement within the cylinder 114). When the boom gate is closed, as in FIG. 3, the piston 113 is spaced away from the upper end of the cylinder. The crankshaft 110 forms an angular continuation of the piston rod 112 as shown. When the boom gate opens the initial movement of the end-portion 9 is away from the pedestal 10 and upwardly. As the speed of movement of the piston 113 in the cylinder 114 is limited by the bleed opening 117 the boom is turned by the unit 17 about a fulcrum provided by the axis of the journals 111 as soon as the latching mechanism disengages. As a result the boom initially rises very rapidly until the pin 4 abuts the bottom end of the slot 5. The fulcrum of the lever is then transferred to the pin 4 and thereafter opening movement of the boom gate is accompanied by movement of the piston 113 into the cylinder 114. Also, the crankshaft 110 swings under compression forces through 180° from the position shown in FIG. 3.

During closing movement of the boom gate the slot 5 is raised with respect to the pivot pin 4. This movement is accompanied by turning of the crankshaft 110 about the journals 111 through an angle of less than 90°, dependent on the dimensions of the crankshaft 110. As the boom commences its descent, the crankshaft 110 continues to turn until it is aligned with the piston shaft 112. This turning movement occurs during the first 30° of descent of the boom gate and during this period the piston 113 does not move in the damper cylinder 114 so that the descent is not damped.

Once the boom has descended through more than 30° the crankshaft 110 is aligned with the piston rod 112 and thereafter the rate of descent of the boom gate, under its own moment, is controlled by the characteristics of the damper unit 114. Thus when the turning moment of the boom gate in the closing direction is least, the damper unit does not exert any braking influence. It is only during the remainder of the boom descent that the damper unit 114 comes into play to prevent the boom gate closing too violently.

The damper unit 114 also improves the opening characteristics of the boom gate by providing the secondary opening fulcrum about which the gate turns rapidly during the short period that the end-portion 9 is being lifted.

Various other modifications to the above described embodiments are possible. The compressed gas supply for operating the boom gate can be provided by a carbon dioxide bottle which is connected through a remotely operable valve to the gas pipe 34. A gas reservoir equipped with a bleed opening may be provided ahead of the gas pipe 34 to ensure that the boom gate is held open for a predetermined period of time determined by the period that the reservoir can maintain gas pressure sufficient to overcome the thrust of the spring 13.

To speed the closing movement of the boom gate the piston 18 may itself be provided with a bleed opening to ensure that when the gas valve is closed, the pressure in the working chamber 21 falls sufficiently quickly for the thrust of the spring 13 to produce almost immediate closing of the boom gate.

Although the spring 13 has been shown within the cylinder 17, it can equally be arranged outside and located, for example, as a compression spring between the block 24 and the lower portion of the lever 6 as shown in broken outline at 12 in FIG. 3.

Other forms of latching mechanism than that illustrated in FIG. 3 may also be used. Also, the piston and cylinder unit may be arranged to be double acting in which case the use of springs 12 and 13 is unnecessary and all that is required is to provide the gas pressure selectively to the opposite ends of the piston-cylinder unit in order to drive the piston selectively in opposite directions, as required, for opening and closing the gate, respectively.

SECOND EMBODIMENT

FIG. 2 shows a boom gate controlling access, in alternation, to two parallel thoroughfares 52. The boom gate comprises a boom 58 forming one end-portion of a first-class lever 56 having a counter-weight at its other end-portion 59 and supported on a pillar 53 providing a bearing 54 which constitutes the fulcrum axis for the lever 56. The free end of the boom 58 rests on a pedestal 50 when the boom gate is closed.

During operation of the boom gate the fulcrum of the lever 56 performs an orbital movement shown by the locus circle 60. The center of gravity of the lever 56 is shown at 70 and it lies within the locus circle 60. Four equiangularly spaced positions 61 to 64 are shown on the locus circle. When the boom gate 58 is shut left, as shown in FIG. 2, the fulcrum axis of the lever 56 coincides with the point 61 of the locus circle and the center of gravity 70 of the lever 56 lies to the left of the fulcrum so that the gate is held closed.

To open the gate the lever 56 follows a path such that the lever fulcrum travels around the locus circle 60 to the point 64 as shown in FIG. *2a*. This movement is performed by means not shown, but which will be described later with reference to FIGS. 6 to 8. The boom gate is not fully opened and both thoroughfares 52 are open.

Continued movement of said means in the same direction causes the boom gate 58 to descend under its own weight, the center of gravity 70 now lying to the right of the bearing 54, to shut the right hand thoroughfare 52 as shown in FIG. *2b*. Such movement is accompanied by some displacement of the boom gate 58 in the direction of its free end and this displacement can be accentuated in order to shut the boom gate positively to the right in order to lock it into a closed position, by continued driving of said means to bring the point 62 on the locus circle into alignment with the bearing 54 providing the fulcrum for the lever 56.

The means for moving the boom gate lever 56 between its operating position is shown in FIGS. 6 to 8.

The boom 58 of the lever is formed by a hollow pole 58 held between a pair of side plates 71 by bolts 72. The pillar 53 on which the lever 56 turns is bifurcated at its upper end and the bifurcations 74 provide coaxially arranged bushing rings defining the bearing 54.

A cranked axial shaft 80 is supported at its ends in the two bushings of the bearing 54 and has keyed to its centre a gear wheel 81 which meshes with a worm 82. As shown in FIG. 6 the worm 82 is driven through a gear reduction drive formed by a pair of meshing pinions 83, from an electric motor 84 located between the two outwardly joggled portions of the side plates 71 of the end-portion 59 of the lever 56. The weight of these plates is such that the centre of gravity of the lever 56 lies within the locus circle 60. This locus circle is defined by the spacing between the axis of bearing axis 54 providing the fulcrum of the lever and the centre of the gear wheel 81.

The end-portion 59 of the lever 56 terminates in a camming surface 85 which has a socket 86 able to engage a cross brace 87 provided between the lower end-portion of the bifurcated pillar 53 to hold the boom vertical.

Electrical connections, not shown, extend from switch gear to the motor 84 and include a reversing switch to enable the motor to be driven in either direction.

OPERATION OF THE SECOND EMBODIMENT

The operation of the means for controlling the position of the boom gate and shown in detail in FIGS. 6 to 8 is best understood from FIG. 6. If the motor 84 is driven in one direction, this drive is transmitted through the gearing 83 and the worm 82 to the gear wheel 81 which is fixed to the cranked portion of the shaft 80. If the end-portions of the shaft 80 were not held captive in the bearing 54, the end-portions would rotate about the circular locus 60. As these end-portions are, however, held captive in the bearing bushes of the bifurcation 74, the lever 56 together with said means moving it, follow an orbital path which brings the points 64, 63 and 62 in turn into registration with the bearing 54. As each of these points on the circular locus 60 comes into registration with the bearing 54, it provides a different fulcrum axis about which the lever turns under its own weight as has already been explained with reference to FIGS. 2 to 2*c*.

Figure 2A:
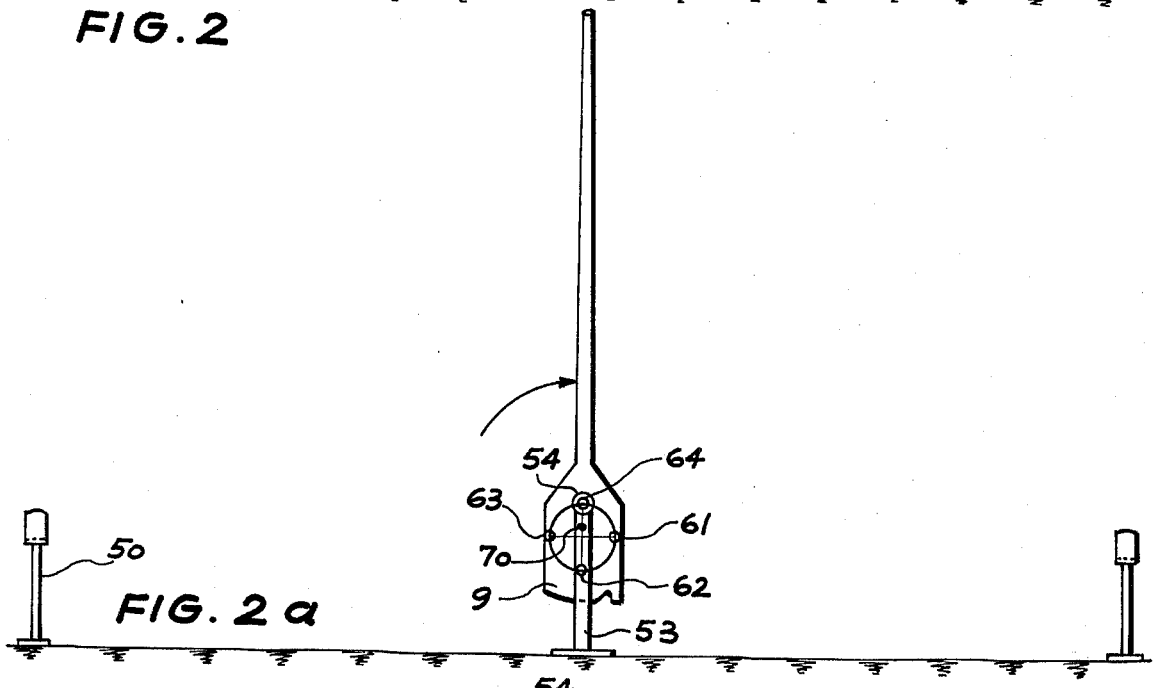
Figure 2B:
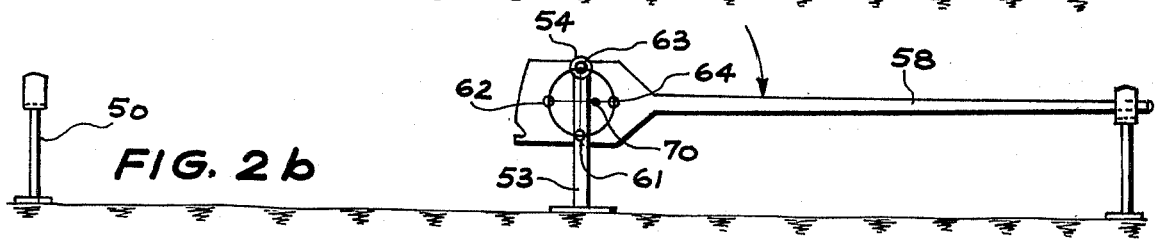
Figure 2C:
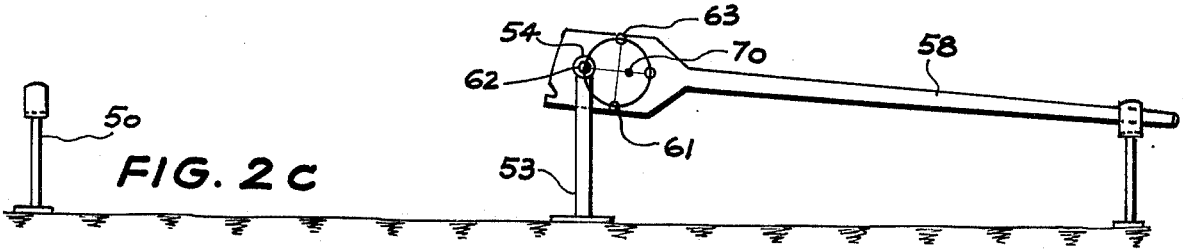

It will be understood that if the lever 56 is required to perform the 180° arc of movement shown in FIGS. 2*b* and 2*c*, the cross brace 87 is either omitted or positioned sufficiently beneath the arc of movement of the end-portion 59 of the lever so as not to obstruct its movement. If the lever is only required to move between a horizontal and vertical position as shown in FIG. 2*a* to control the access to one thoroughfare only, the cross brace 87 can then be used to define the end of the opening movement of the lever.

To move the boom gate in a reverse direction, the electrical connections to the motor are reversed.

MODIFICATIONS OF SECOND EMBODIMENT

Various modifications to the second embodiment are possible. For example, it is not strictly necessary to reverse the direction of motion of the motor 84 in order to return the boom gate from the position shown in FIG. 2*c*. Continued rotation of the motor in the same direction will bring first the point 61 on the locus circle 60 into registration with the bearing 54, and subsequently point 64. This will cause the centre of gravity 70 to move from the right-hand side of the bearing 54 to the left-hand side with the result that the boom gate 58 will turn under its own moment to the closed position shown in FIG. 2.

An advantage of the arrangement shown in FIGS. 6 to 8 is that the means used to determine the boom gate position can be totally enclosed between the side plates 71 and the only connections necessary to the moving parts of the lever 56 are the electrical connections to the motor 84. These may be provided by slip rings centred on the axis of the bearing 54 and engaged by brushes located between the plates 71 and which ensure that electrical connection to the motor is maintained at all positions of the boom gate and irrespective of the number of rotations of the cranked shaft 80 about the bearing 54.

THIRD EMBODIMENT

The third embodiment illustrated in FIGS. 9 to 10 corresponds in its operation to that shown in FIG. 1 and corresponding parts bear like reference numerals and they will thus only briefly be described to save needless repetition.

A lever 6 provides a boom 8 with one end-portion and the other end-portion 9 is counter-weighted so that the centre of gravity of the lever lies at 7. A fulcrum axis coincides with that of a pivot shaft 4 which extends across the bifurcated end of a pillar 3.

The pivot shaft 4 is shown more clearly in FIG. 10 and it carries a pair of rollers 90 which are respective sliding fits in two parallel aligned slots 5 formed in side plates 91 which together provide the counter balanced end-portion 9 of the lever 6.

Between the roller 90 the shaft 4 carries a pinion 92 meshing with a rack 93 mounted between the two plates 91 and rigidly connected to them. Shock absorbers 94 are also mounted between the plates 91 and prevent the boom gate experiencing too violent a shock when reaching the two ends of its travel which are determined by the length of the slots 5.

The pivot shaft 4 has a square end-portion 96 carrying a handle 97 used to rotate the shaft.

OPERATION OF THE THIRD EMBODIMENT

When the boom gate is horizontal, its centre of gravity 7 is located close to the vertical plane of the pivot shaft 4 so that the moment it exerts turning to keep the boom gate in its horizontal position is quite small and can easily be overcome by rotating the handle 97. This causes the rack 93 to ride up the pinion, so raising the centre of gravity of the lever 6 and at the same time moving it across the axis of the lever fulcrum 7 so that the boom gate is displaced initially towards the right in FIG. 9 and then turns towards its open position as the turning moment increases. When the pinion reaches the end of its travel along the rack 93 the pivot shaft 4 abuts the shock absorber 94. The boom gate is then in a vertical position.

To lower the boom gate the handle 97 is turned in the reverse direction to raise the rack upwards and towards the left around the pinion 92 until the centre of gravity has travelled across it to the left hand side in FIG. 9. The boom gate then descends under its own weight and comes to a horizontal position when the pivot shaft 4 engages the upper of the two shock absorbers 94 shown in FIG. 9.

It will be noticed in all of the embodiments that the moment tending to hold the boom gate closed and extending towards the left in the figures, is relatively small and is capable of easily being overcome by means of a low torque drive. The movement of the boom gate between its different positions is accomplished by its own weight as a result of the shift of its centre of gravity across the fulcrum about which the boom gate lever turns. The movement of the boom during initial movement of the centre of gravity also serves to disengage a latch holding it closed so that rotation of the boom to the open position can be accomplished under its own weight and without the application of an external drive.

In all of the above embodiments the line joining the centres of gravity of the two end-portions of the lever passes beneath the fulcrum axis when the boom gate is closed. As the boom gate opens the line rises and when the boom gate is open the line is at least on or preferably above the horizontal plane through the fulcrum axis.

Although the embodiments described above employ booms which swing in the vertical plane this is not essential for carrying out the invention. Indeed, by inclining the fulcrum axis in the horizontal plane with respect to the longitudinal axis of the lever, the boom can be arranged to swing upwardly from a horizontal position to an upright position which it is effectively folded back so as to be accommodated in a space in which headroom is restricted.

The boom gates described can be remotely controlled and the unique latching mechanism which is self locking and self releasing with closing and opening movements of the boom make unnecessary the provision of special connections to operate the unlatching mechanism on the opposite side of the thoroughfare to the pillar providing the lever fulcrum axis.

I claim:

1. A boom gate comprising a support pillar, bearing means on said pillar, a first-class lever pivotable about said bearing means and having a first end-portion, forming a boom to be raised and lowered, and a second end-portion providing a counterweight, giving the lever a center of gravity disposed adjacent a fulcrum axis for the lever provided by said bearing means, and fulcrum displacement means operable to displace said lever lengthwise with respect to said bearing means, whereby the center of gravity is transferred from one side of the lever fulcrum axis to the other side to turn the lever by its own weight around the axis, wherein said fulcrum displacement means include a piston and cylinder unit, a source of pressure fluid, valving for connecting the pressure fluid source to said piston and cylinder unit to operate the boom gate, and latching means controlled by said boom.

2. A boom gate as claimed in claim 1, wherein said bearing means includes a pivot shaft defining internally an axial gas flow passage connected at one end to said pressure fluid source and at the other end to a lateral opening intermediate to the ends of the shaft, a bearing block rotatable around said pivot shaft and having a bore communicating with said lateral opening, a cylinder of said unit being connected to said block with a working chamber in communication with said bore, said piston of a unit being connected at its end to said lever, a resilient spring acting on said unit and urging said piston into said working chamber, and slots formed in said lever and defining the path of its movement with respect to said bearing means when said fulcrum displacement means is operated.

3. A boom gate comprising a support pillar, bearing means on said support pillar, a first class lever pivotable about said bearing means and having a first end-portion forming a boom to be raised and lowered, and a second end-portion of shorter length and counterweighted to provide said lever with a centre of gravity adjacent a fulcrum axis for said lever provided by said bearing means, fulcrum displacement means operable to displace said lever lengthwise and transversely with respect to said bearing means to transfer the centre of gravity of said lever from one side of said fulcrum axis to said other side, said lever being formed with guide slot means co-operating with said bearing means and defining said path of movement of said lever with respect thereto when said fulcrum displacement means are operated, boom latching means having a first part attached to the end of said first end-portion of the lever and a second part attached to a fixed pedestal, said two parts co-operating with one another to latch the boom in its closed position, and such parts including a pawl and latch which are disengageable from one another to unlatch said boom latching means and allow the boom to rise such disengagement being effected automatically by horizontal retraction movement of said lever in said direction of said support pillar before it lifts to its raised position, whereby said boom latching means are operated by boom movement in opposite directions to engage and release said latching means, respectively.

4. A boom gate as claimed in claim 3, wherein said bearing means includes a pivot shaft, a handle on said support pillar to rotate said shaft manually, a pinion on said shaft and rack meshing with said pinion on said lever, extending parallel to said guide slot means.

5. A boom gate comprising a support pillar providing two bifurcations, aligned bearings on respective bifurcations defining a fulcrum axis, a first-class lever pivotable about the fulcrum axis and displaceable lengthwise at right angles to the fulcrum axis, a first end-portion to said lever and of extended length to provide a boom, latching means self-engaging when said boom is horizontal and located between the boom end and a latching station, a second end-portion to said lever of shorter length than said first end-portion and providing a counterweight which provides said lever with a centre of gravity which, when the gate is closed, is disposed adjacent the vertical plane of the fulcrum axis and below the horizontal plane of the fulcrum axis, fulcrum displacement means operable to displace said lever lengthwise and upwardly to transfer the centre of gravity to the other side of the fulcrum axis to a position lying at least on said horizontal plane, a pair of parallel spaced guide slots provided on the lever and bearing shaft portions on said bifurcations which pass through said slots and which co-operate with them to define the path of movement of the fulcrum axis with respect to said lever, a stop fixed to said pillar beneath said level of the lever, and a socket provided on said second end-portion to engage with said stop and arrest raising movement of said boom when in the desired upright position.

6. A boom gate as claimed in claim 5, in which the fulcrum displacement means is pneumatically operated, further comprising a compressed gas bottle connected to provide pneumatic fluid to said fulcrum displacement means, a valve operable to control flow of pneumatic fluid, a spring providing a bias against which said fulcrum displacement means operates, a reservoir for pneumatic fluid, connected between said gas bottle and said fulcrum displacement means, and a bleed valve controlling the time for which the boom gate is held open after closing of said gas valve.

7. A boom gate as claimed in claim 5, including a damper unit formed by a piston and a cylinder connected in theory with a crankshaft between said support pillar and said second end-portion of the lever whereby when the boom gate is horizontal the pivotal connection to said end-portion provides an auxiliary fulcrum for said lever, effective during initial opening movement of the boom gate before said fulcrum axis of the lever takes effect, said crankshaft being also effective to allow initial closing movement of the boom gate from an open position to take place without braking effect which comes into play during the latter part of the closing movement of the boom gate.

8. A boom gate as claimed in claim 5, further comprising latching means holding said boom in the closed position, engagement and disengagement of said latching means being effected respectively by longitudinal movement of said boom in opposite directions.

9. A boom gate comprising a support pillar; bearing means on said pillar providing a fulcrum axis; a first-class lever pivotable about said bearing means and on the fulcrum axis; a first end portion of said lever forming the gate boom that can be raised and lowered by turning said lever about the fulcrum axis, the gate boom having one free end; a second end portion of said lever providing a counterweight that gives said lever a center of gravity adjacent to the fulcrum axis; and drive means operatively connected to displace said lever horizontally in the direction of its length and relative to the fulcrum axis; whereby to open the boom gates, said drive means brings said free end of the gate boom nearer said pillar to move the center of gravity from one side of the fulcrum axis to the other so that the weight of said lever assists subsequent upward turning movement of the gate boom to its open position.

* * * * *